US006848659B1

(12) United States Patent
Liu

(10) Patent No.: US 6,848,659 B1
(45) Date of Patent: Feb. 1, 2005

(54) STORAGE STAND

(76) Inventor: George C. M. Liu, No. 1-10, Hsing-Chung Rd., Tou-Nan Chen, Yunlin Hsien (TW)

( * ) Notice: Subject to any disclaimer, the term of this patent is extended or adjusted under 35 U.S.C. 154(b) by 0 days.

(21) Appl. No.: 10/670,229

(22) Filed: Sep. 26, 2003

(30) Foreign Application Priority Data

Feb. 18, 2003 (TW) ..... 92202478 U

(51) Int. Cl.[7] ..... A47G 23/02; A47B 9/00

(52) U.S. Cl. ..... 248/146; 108/147.13; 403/371; 211/187

(58) Field of Search ..... 248/146, 151, 248/127; 108/190, 147.13, 147.12, 147.15; 403/172, 371, 97, 344, 375, 369, 370, 368, 379.6, 297, DIG. 12; 211/187

(56) References Cited

U.S. PATENT DOCUMENTS 3,065,860 A * 11/1962 Swanson ..... 211/153
3,874,511 A * 4/1975 Maslow ..... 211/153
3,915,101 A * 10/1975 Onori ..... 108/192
4,132,178 A * 1/1979 Mueller et al. ..... 108/147.14
4,138,953 A * 2/1979 Tashman ..... 108/147.13
4,237,798 A * 12/1980 Welsch et al. ..... 108/192
4,496,125 A * 1/1985 Walsh et al. ..... 248/188
4,615,278 A * 10/1986 Cabrelli ..... 108/192
4,637,323 A * 1/1987 Nicely ..... 108/107
4,750,626 A * 6/1988 Nicely ..... 211/187
4,811,670 A * 3/1989 Kolvites et al. ..... 108/107
4,892,044 A * 1/1990 Welsch ..... 108/154
5,354,025 A * 10/1994 McCaffrey ..... 248/188
6,065,407 A * 5/2000 Wang ..... 108/147.13
6,247,414 B1 * 6/2001 Sikora et al. ..... 108/190

* cited by examiner

*Primary Examiner*—Anita M. King
(74) *Attorney, Agent, or Firm*—Troxell Law Office PLLC

(57) ABSTRACT

A storage stand has multiple shelves, split tubular sleeves, brackets and vertical supports. Each shelf has multiple corners and each bracket is mounted at one of the corners under the shelves to hold a split tubular sleeve by welding. The vertical supports are mounted between adjacent shelves. Since the welds are hidden under each shelf, the storage stand has an aesthetic appearance and can be easily assembly.

3 Claims, 5 Drawing Sheets

STORAGE STAND

BACKGROUND OF THE INVENTION

1. Field of the Invention

The present invention relates to a storage stand, and more particularly to a storage stand that is cheap to make.

2. Description of Related Art

With reference to FIGS. 4 and 5, a conventional storage stand (40) has multiple shelves (42) and vertical supports (41).

Each shelf (42) is rectangular and has four corners (not numbered) and four tubular sleeves (43). Each corner has an arcuate edge (420). Each tubular sleeve (43) has an inside diameter is welded in one of the arcuate edges (420) with two welds (431).

Each vertical support (41) is tubular and has a diameter, an upper end (not numbered) and a lower end (not numbered). The diameter of the vertical support (41) is slightly smaller than the diameter of the tubular sleeve (43) attached to each corner of the shelf (42). The vertical supports (41) are mounted respectively in the tubular sleeves (43) attached to the shelf (42) and between adjacent shelves (42).

The conventional storage stand (40) has the following disadvantages.

1. The welds (431) attaching the tubular sleeves (43) to the shelves (42) are not easily made smooth, which will detract from the outer appearance.

2. For the manufacturer to smooth the welds (431) will an additional procedure and more time and money to perform the procedure.

The present invention provides a storage stand to mitigate or obviate the aforementioned problem.

SUMMARY OF THE INVENTION

The primary objective of the present invention is to provide a storage stand with an aesthetic appearance that can be made with a simple process.

A storage stand in accordance with the present invention has multiple shelves, split tubular sleeves, brackets and vertical supports. Each shelf has multiple corners, and each bracket is mounted in one of the corners under the shelves to hold one of the split tubular sleeves. The vertical supports are mounted between adjacent shelves. The storage stand has an aesthetic appearance and can be easily assembled.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
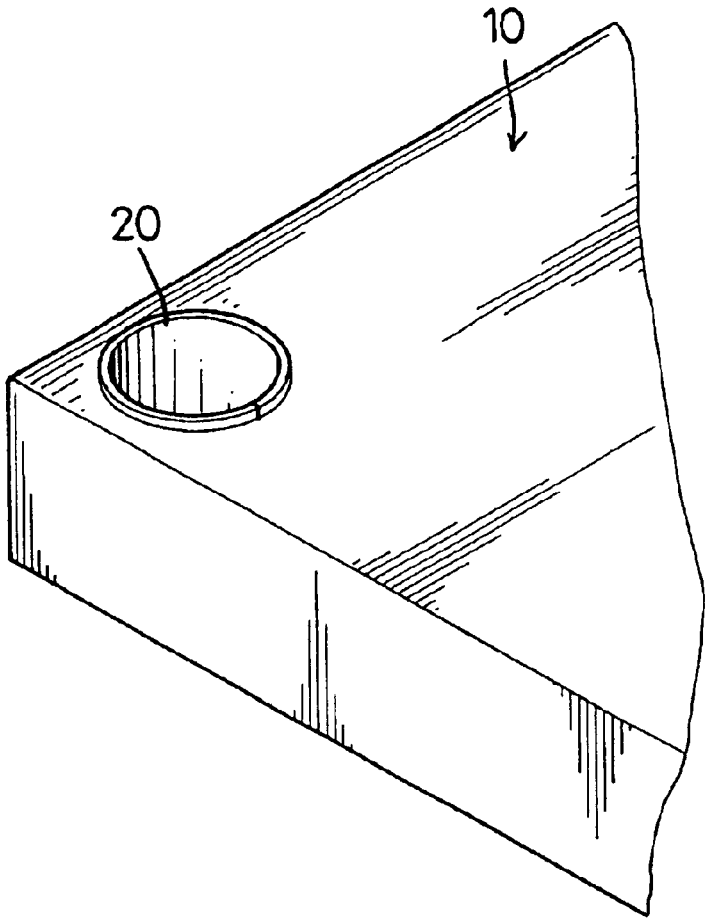
FIG. 1 is a perspective view of a corner of shelf of a storage stand in accordance with the present invention.
Figure 2:
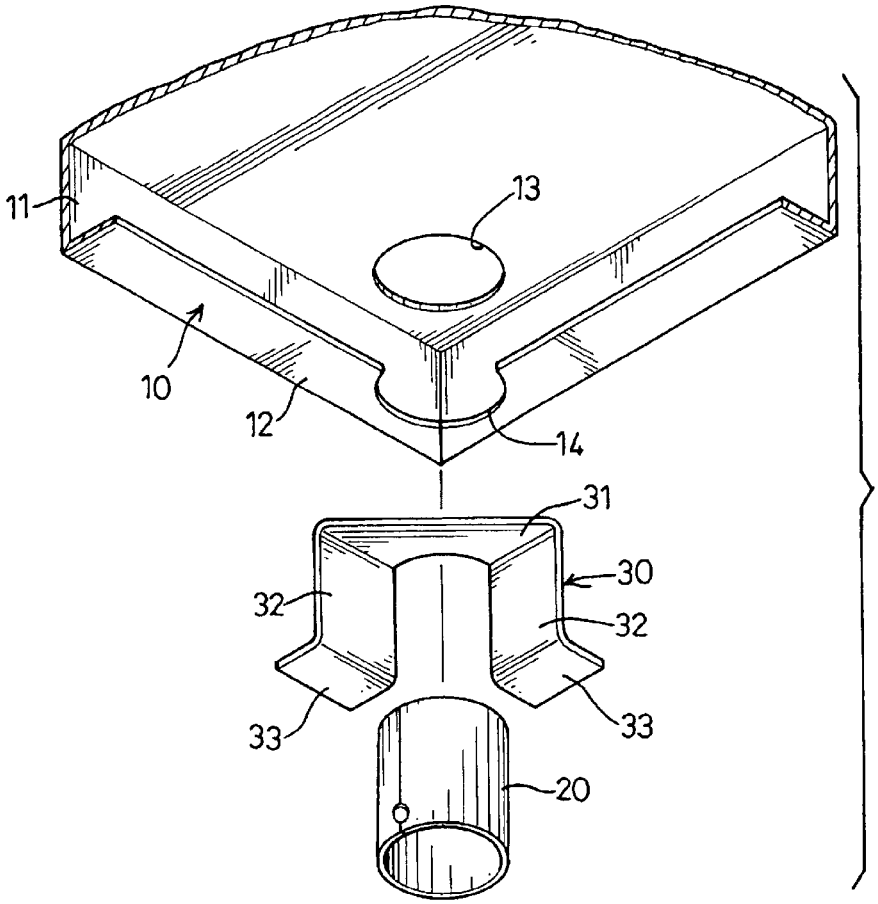
FIG. 2 is an exploded perspective bottom view of the corner of the shelf of the storage stand in FIG. 1.
Figure 3:
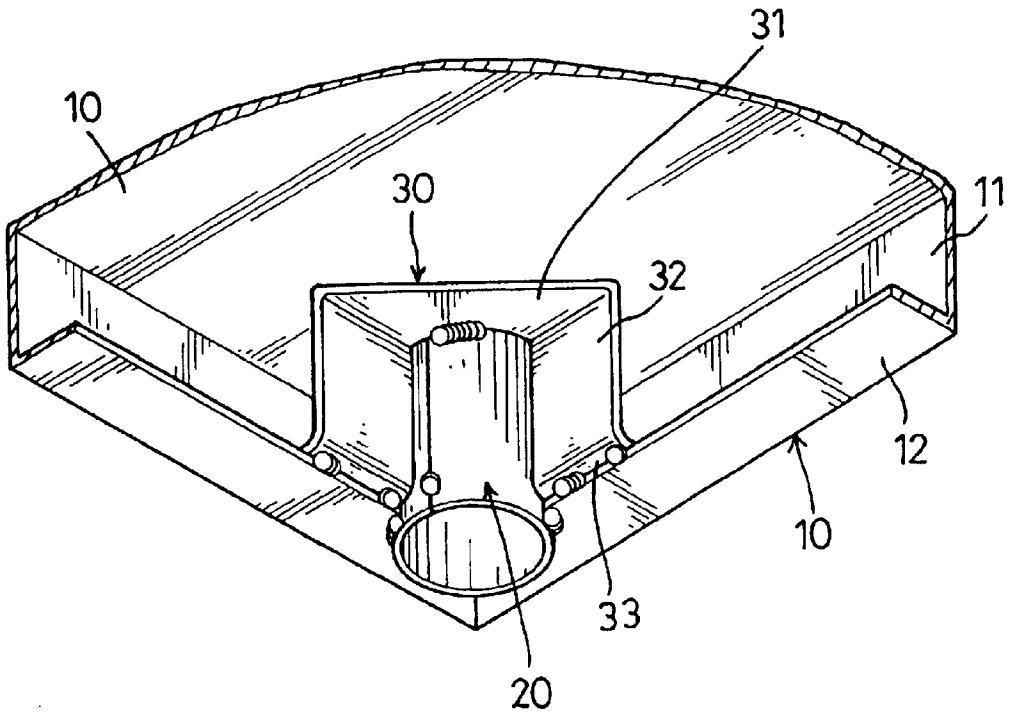
FIG. 3 is a perspective bottom view of corner of the shelf of the storage stand in FIG. 2.
Figure 4:
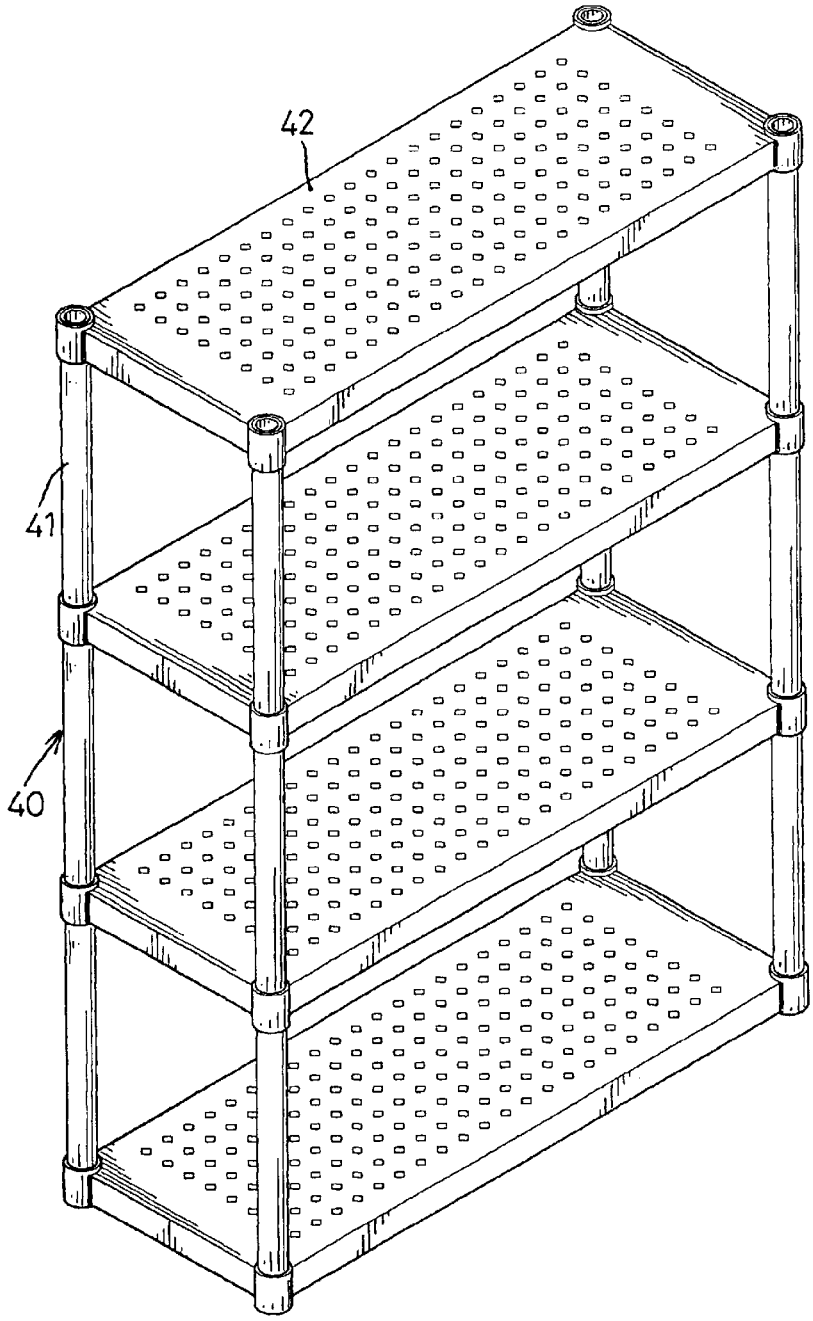
FIG.4 PRIOR ART
FIG. 4 is a perspective view of a conventional storage stand in accordance with the prior art.
Figure 5:
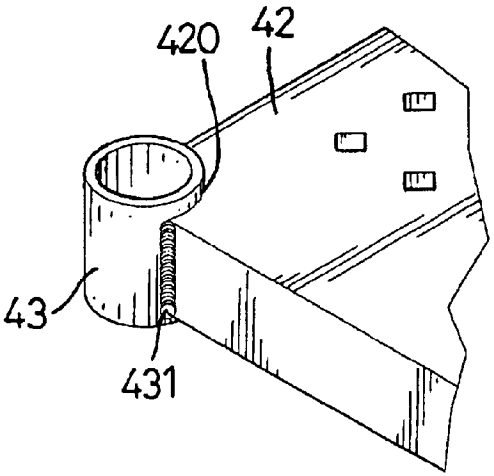
FIG.5 PRIOR ART
FIG. 5 is a perspective view of a corner of a shelf of the conventional storage stand in FIG. 4.

With reference to FIGS. 1 to 3, a storage stand in accordance with the present invention has multiple shelves

(10), split tubular sleeves (20), brackets (30) and vertical supports (not shown).

Each shelf (10) has a bottom surface (not numbered), a top surface (not numbered) with at least three edges (not numbered), and a corresponding number of corners (not numbered), through holes (13), vertical edges (11) and bottom lips (12). The most common embodiment of the storage stand has shelves (10) with four edges, four through holes and four corners. The vertical edges (11) have an upper edge (not numbered) and a lower edge (not numbered), and the upper edges are integrally formed with the edges of the top surface. The bottom lips (12) are integrally formed with lower edges of the vertical edges (11). The through holes (13) are defined through the top surface respectively near the corners, and a corresponding arcuate edges (14) are formed in the bottom lips (12) respectively at the corners.

The brackets (30) are attached to the bottom surface of the shelf (10) and hold respectively the split tubular sleeves (20). Each bracket (30) corresponds to one of the corners and has a top piece (31), two vertical braces (32) and two tabs (33). The top piece (31) is trapezoidal with two non-parallel ends (not numbered). The two vertical braces (32) are formed respectively with the non-parallel ends. When a shelf (10) has four corners, the vertical braces (32) in each bracket (30) are formed at a 90° angle relative to each other. For a shelf (10) with three corners, the vertical braces (32) in each bracket (30) are formed at a 120° angle relative to each other. The tabs (33) are integrally formed with the vertical braces (32) and extend out 900 from the vertical braces (32). The top piece (31) further has a curved edge (not numbered) corresponding to the through hole (13).

Each split tubular sleeve (20) has an outside surface (not numbered) and is mounted inside one of the through holes (13) and the corresponding arcuate edge (14) in the bottom lips (12). A bracket (30) is inserted between the bottom lips (12) and the bottom surface of the shelf (10) so that the curved edge of the top piece (31) abuts the split tubular sleeve (20). The bracket (30) is then spot welded to the split tubular sleeve (20) and the bottom lips (12) to securely hold the split tubular sleeve (20) in place. The vertical supports support each shelf (10) and has two ends. The ends of the vertical support are inserted respectively into corresponding split tubular sleeves (20) of adjacent shelves (10).

Because the welds are hidden under the shelf (10), the welds will not detract from the outer appearance, and no need exists to grind the welds. Consequently no further procedure is required, and the storage stand can be produced in a short time.

Even though numerous characteristics and advantages of the present invention have been set forth in the foregoing description, together with details of the structure and function of the invention, that the disclosure is illustrative only, and changes may be made in detail, especially in matters of shape, size, and arrangement of parts within the principles of the invention to the full extent indicated by the broad general meaning of the terms in which the appended claims are expressed is to be understood.

What is claimed is:

1. A storage stand having multiple shelves each having a bottom surface;

a top surface with at least three edges;

multiple corners and each formed between two of the at least three edges;

multiple through holes defined through the top surface and each through hole being near one of the corners;

vertical edges each integrally formed with one of the edges of the top surface; and bottom lips integrally formed with each vertical edge and having arcuate edges corresponding to the through holes;

multiple split tubular sleeves and each split tubular sleeve mounted inside one of the through holes and a corresponding one of the arcuate edges;

multiple brackets mounted between the bottom surface of the shelf and the bottom lips to hold the split tubular sleeves and each having a top piece with a curved edge to abut and be welded to the split tubular sleeve and two non-parallel ends;

two vertical braces integrally formed respectively with the non-parallel ends of the top piece; and two tabs integrally formed respectively with and extending out from the vertical braces and welded to the bottom lips between which the split tubular sleeve is mounted; and multiple vertical supports mounted between adjacent shelves and each vertical support having one end inserted into two of the split tubular sleeves.

2. The storage stand as claimed in claim 1, wherein the vertical braces are oriented at 90° with regard to each other when each shelf has four corners.

3. The storage stand as claimed in claim 1, wherein the vertical braces are oriented at 120° with regard to each other when each shelf has three corners.

* * * * *